US007192168B2

(12) United States Patent
Day

(10) Patent No.: US 7,192,168 B2
(45) Date of Patent: Mar. 20, 2007

(54) LIGHTING SYSTEM

(76) Inventor: Scott M. Day, 3925 W. Barnard Ave., Greenfield, WI (US) 53221

( * ) Notice: Subject to any disclaimer, the term of this patent is extended or adjusted under 35 U.S.C. 154(b) by 202 days.

(21) Appl. No.: 11/046,329

(22) Filed: Jan. 29, 2005

(65) Prior Publication Data

US 2006/0171147 A1 Aug. 3, 2006

(51) Int. Cl.
*F21S 8/08* (2006.01)

(52) U.S. Cl. ..... 362/431; 362/249; 362/812

(58) Field of Classification Search ..... 362/153, 362/234, 249, 250, 252, 391, 403, 431, 806, 362/812; 116/173; 40/502, 601, 603
See application file for complete search history.

(56) References Cited

U.S. PATENT DOCUMENTS 1,256,232 A * 2/1918 Howard ..... 362/234
5,477,437 A * 12/1995 Lach ..... 362/252
6,039,458 A * 3/2000 Coates et al. ..... 362/251
6,783,259 B1 * 8/2004 Macedonio ..... 362/806
6,955,456 B2 * 10/2005 Schroeder ..... 362/431
2006/0023446 A1 * 2/2006 Racoosin ..... 362/227

* cited by examiner

*Primary Examiner*—Y. My Quach-Lee

(57) ABSTRACT

A decorative lighting apparatus comprising a decorative member comprising a plurality of lights configured to simulate an appearance of a decorative design and an elongate member coupled to the plurality of lights. The plurality of lights are configured to provide light when electrically powered, the plurality of lights are configured to be in electric communication with an electric power source, and the member is configured to couple to a pulley system so that the decorative member may be provided in at least a first position and a second position by moving the pulley system.

20 Claims, 5 Drawing Sheets

10
11
12
29
28
46
26
14
30
32
18
16
44
13
9
85

16
12
18

12
20
22
24

FIGURE 10
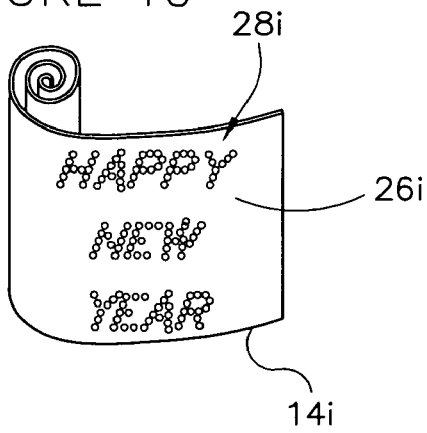
FIGURE 11
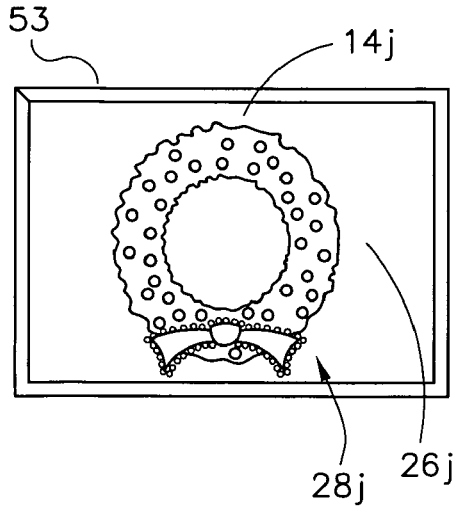
FIGURE 12
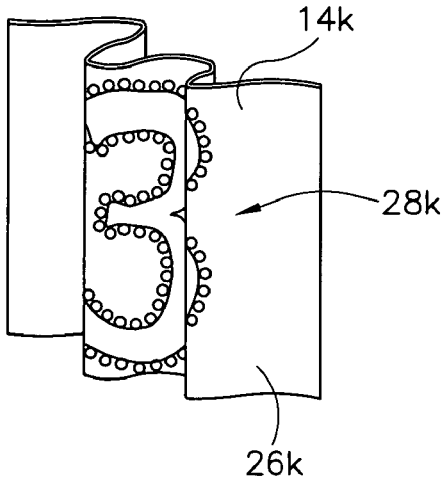
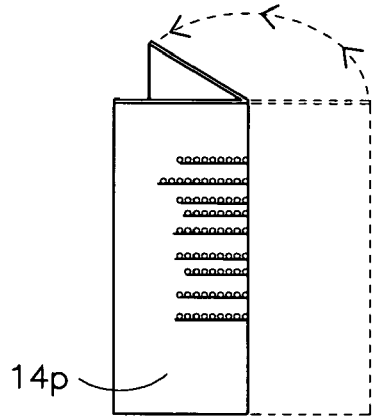
FIGURE 13
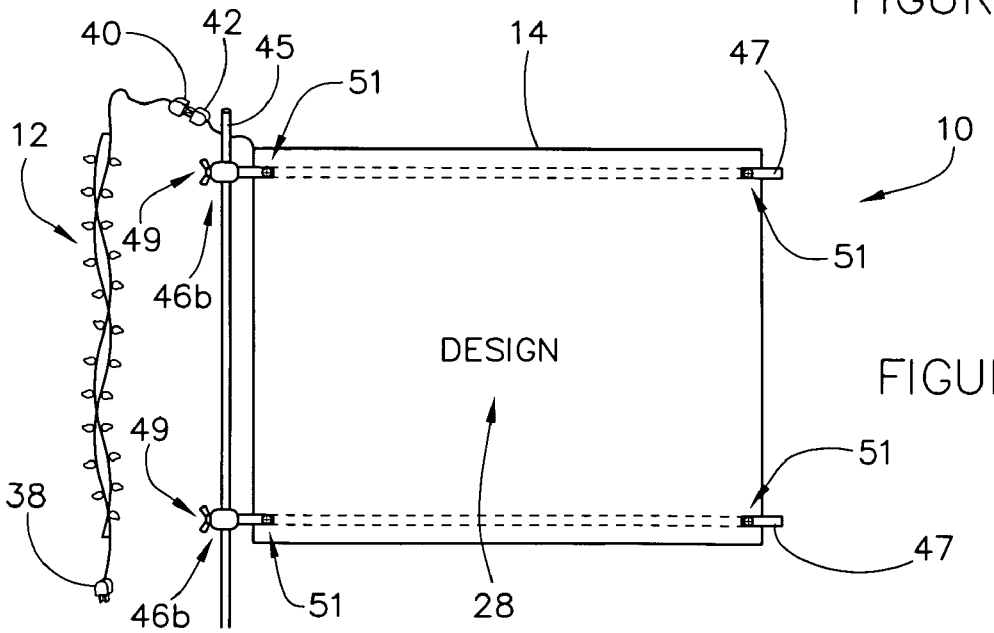
FIGURE 14

LIGHTING SYSTEM

FIELD

The present invention relates to decorative lights. In particular, the present invention relates to decorative lights for structures such as flagpoles, buildings, and the like.

BACKGROUND

It is known to provide lighting for seasonal and holiday decorations. Many known lighting systems are intended to be placed on eaves, gutters, railings, or edges of homes or other buildings. Such known systems typically include a string of decorative lights spaced apart in a line and connected by a wiring circuit. However, these types of known systems are oftentimes not suitable for decorating many different types of poles, posts, beams or other like structures and oftentimes require complicated connection devices or other adhesives. Further, many known systems are not configured for use with flagpoles wherein the lights may be raised and lowered on the pole with the use of a flagpole pulley system. Such known systems are not configured to include or be coupled to a decorative device, such as a flag or other decorative design having lights, which may be illuminated for viewing and positioned at a desired height on the flagpole. Many known decorative lighting systems are not configured for the attachment of one of a plurality of different interchangeable decorative members or symbols.

It would be advantageous to provide a decorative lighting system or apparatus for use with poles or other like structures, such as flagpoles. It would be advantageous to provide a decorative lighting system that may be coupled to a flagpole so that at least a portion of the system may be raised or lowered in a vertical manner along a length of the pole. It would further be advantageous to provide a decorative lighting system that is configured for use with a pulley system (e.g., flagpole pulley system) for positioning the lighting system at a desired height on a pole, post or other suitable structure (e.g., a flagpole). It would further be advantageous to provide a decorative lighting system that comprises a decorative member or symbol. It would further be advantageous to provide a decorative lighting system that comprises a plurality of illumination devices that provide light when electrically powered. It would further be advantageous to provide a decorative lighting system that comprises a plurality of illumination devices arranged to resemble and/or simulate a flag or other design or image such as a sporting symbol, logo, seasonal decoration, etc. It would further be advantageous to provide a decorative lighting system that is configured to be in electric communication with an electric power source to provide electric power to illumination devices of the system. It would further be advantageous to provide a decorative lighting system that is configured for the attachment of one of a plurality of different interchangeable decorative panels or members and for attachment to a pole, such as a flagpole. It would further be advantageous to provide a decorative lighting system that simulates the appearance of a lighted flag or other design or image such as a sports symbol, logo, seasonal decoration, etc. that may be flown and/or displayed atop a flagpole.

It would be advantageous to provide a system or the like of a type disclosed in the present application that provides any one or more of these or other advantageous features. The present system further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

SUMMARY

A decorative lighting apparatus comprising a decorative member comprising a plurality of lights configured to simulate an appearance of a decorative design and an elongate member coupled to the plurality of lights. The plurality of lights are configured to provide light when electrically powered, the plurality of lights are configured to be in electric communication with an electric power source, and the member is configured to couple to a pulley system so that the decorative member may be provided in at least a first position and a second position by moving the pulley system.

A decorative lighting apparatus comprising an elongate member comprising a plurality of illumination devices, the illumination devices providing light when electrically powered and a decorative member configured to couple to the elongate member, wherein the decorative member comprises a plurality of illumination devices arranged to simulate a flag. The illumination devices are configured to be in electric communication with an electric power source to provide electric power to the illumination devices and the decorative member is configured to couple to a flagpole pulley system so that the decorative member can be moved between a first height and a second height along the flagpole.

A modular decorative lighting apparatus comprising a base configured to couple to a pulley system so that the base can be provided at one of a plurality of different heights along the pulley system by actuation of the pulley system, a first interchangeable decorative member configured to couple to the base, wherein the first interchangeable decorative member comprises a plurality of illumination devices arranged to simulate an appearance of a decorative design, and an elongate member configured to couple to the plurality of illumination devices of the interchangeable decorative member. The base is configured for attachment of the first interchangeable decorative panel to provide a first simulated appearance of a decorative design on a first side of the base and the illumination devices are configured to be in electric communication with an electric power source to provide electric power to the illumination devices when attached to the electric power source.

BRIEF DESCRIPTION OF THE DRAWINGS

FIG. 10 is a front elevation view of a decorative member or symbol according to an exemplary embodiment.

FIG. 11 is a front elevation view of a decorative member or symbol according to an exemplary embodiment.

FIG. 12 is a front elevation view of a decorative member or symbol according to an exemplary embodiment.

FIG. 13 is a front elevation view of a decorative member or symbol according to an exemplary embodiment.

FIG. 14 is a schematic view of a decorative member or symbol of a decorative lighting system according to an exemplary embodiment.

DETAILED DESCRIPTION

Figures 1, 2, 3:
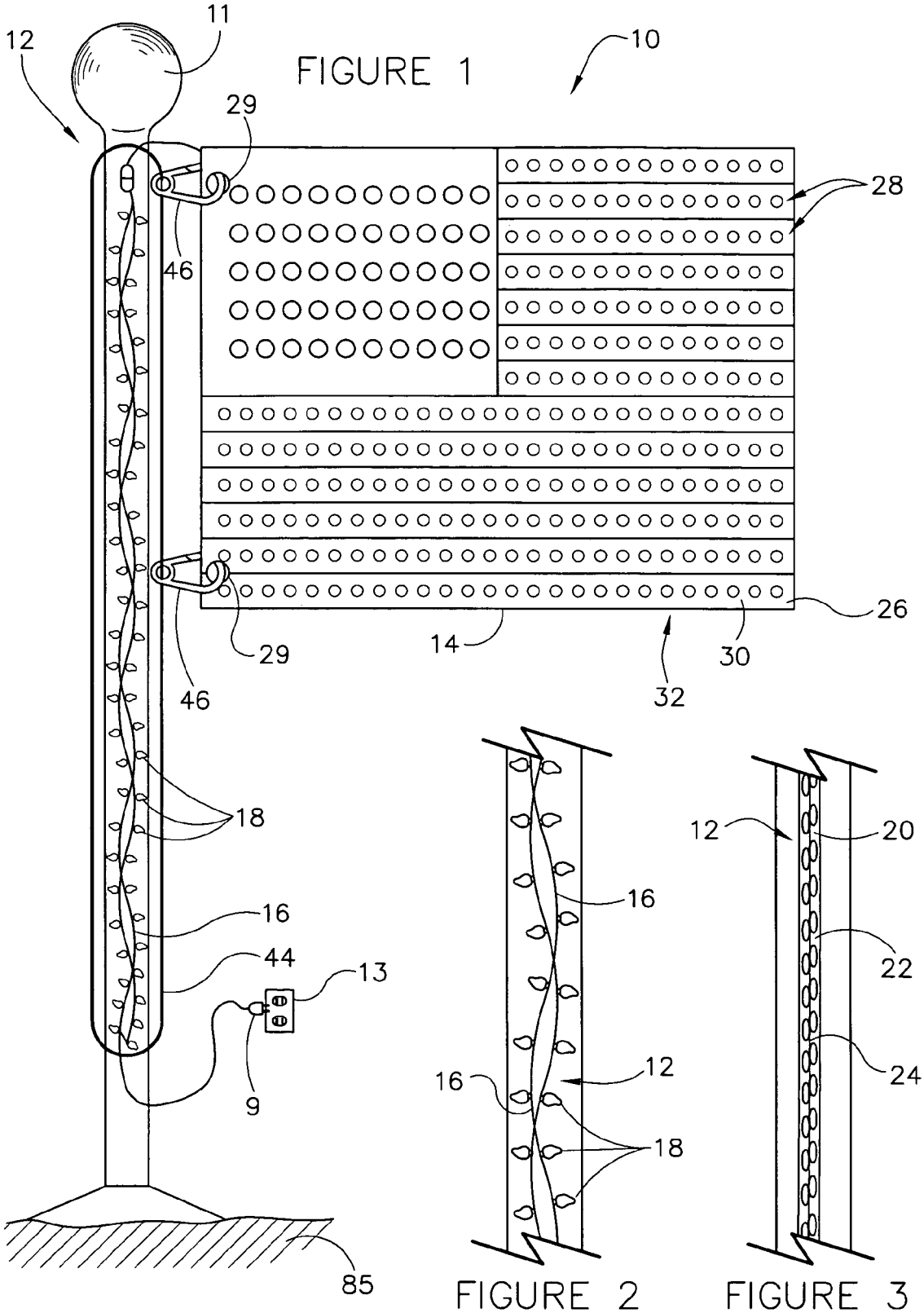
FIG. 1 is a front perspective view of a decorative lighting system according to an exemplary embodiment.
FIG. 2 is detailed view of a light strand of a decorative lighting system according to an exemplary embodiment.
FIG. 3 is a detailed view of a light strand of a decorative lighting system according to an exemplary embodiment.

According to an exemplary embodiment shown in FIG. 1, a lighting system 10 is provided that allows for attachment to a pole, such as a flagpole 11. System 10 comprises an elongate member 12 (e.g., a light strand) and a decorative symbol or member 14 (e.g., a plurality of lights that simulate a symbol such as the appearance of a flag) adapted to be attached to flagpole 11, preferably above the ground or other horizontal surface or plane (e.g., at a desired vertical height). According to an alternative embodiment, the flagpole and/or system may be mounted to a structure such as a building (e.g., home). As shown in FIG. 1, pole 11 is mounted to structure 85 (e.g., ground, building, home, etc.). According to an exemplary embodiment shown in FIGS. 1 and 2, elongate member 12 comprises a light strand 16 comprising a plurality of lights 18 which are disposed in a spaced relationship. Elongate member 12 is configured to be in electric communication with an electric power source (such as between plug 9 and electric socket 13 shown in FIG. 1) and provide light when electrically powered. According to various exemplary embodiments, the lights may be a single color or may be many different colors. According to an exemplary embodiment, the elongate member may be coupled to the decorative symbol or member to form and/or simulate the symbol. According to an exemplary embodiment, the elongate member may be an extension cord (e.g., having any number of lights or having no lights). According to various exemplary embodiments, the elongate member may be formed as part of the decorative symbol or member, may be formed separately from the decorative symbol, etc.

According to an exemplary embodiment, elongate member 12 may comprise a substantially transparent flexible sleeve 20 shown in FIG. 3. Flexible sleeve 20 comprises a generally transparent hose 22 which may be in a variety of different colors and made of flexible plastic material. A string of the lights or a light strand 24 is positioned within hose 22 along a length of hose 22. According to various exemplary embodiments, the light strand may or may not be removable from the flexible sleeve. Flexible sleeve 20 and/or light strand 24 may be configured to be in electric communication with an electric power source and provide light when electrically powered. According to various exemplary embodiments, any number of light strands may be provided in the flexible sleeve and/or with the lighting system. According to various exemplary embodiments, any number of flexible sleeves and/or light strands may be coupled to the decorative member and/or flagpole or other structure.

Figure 4:
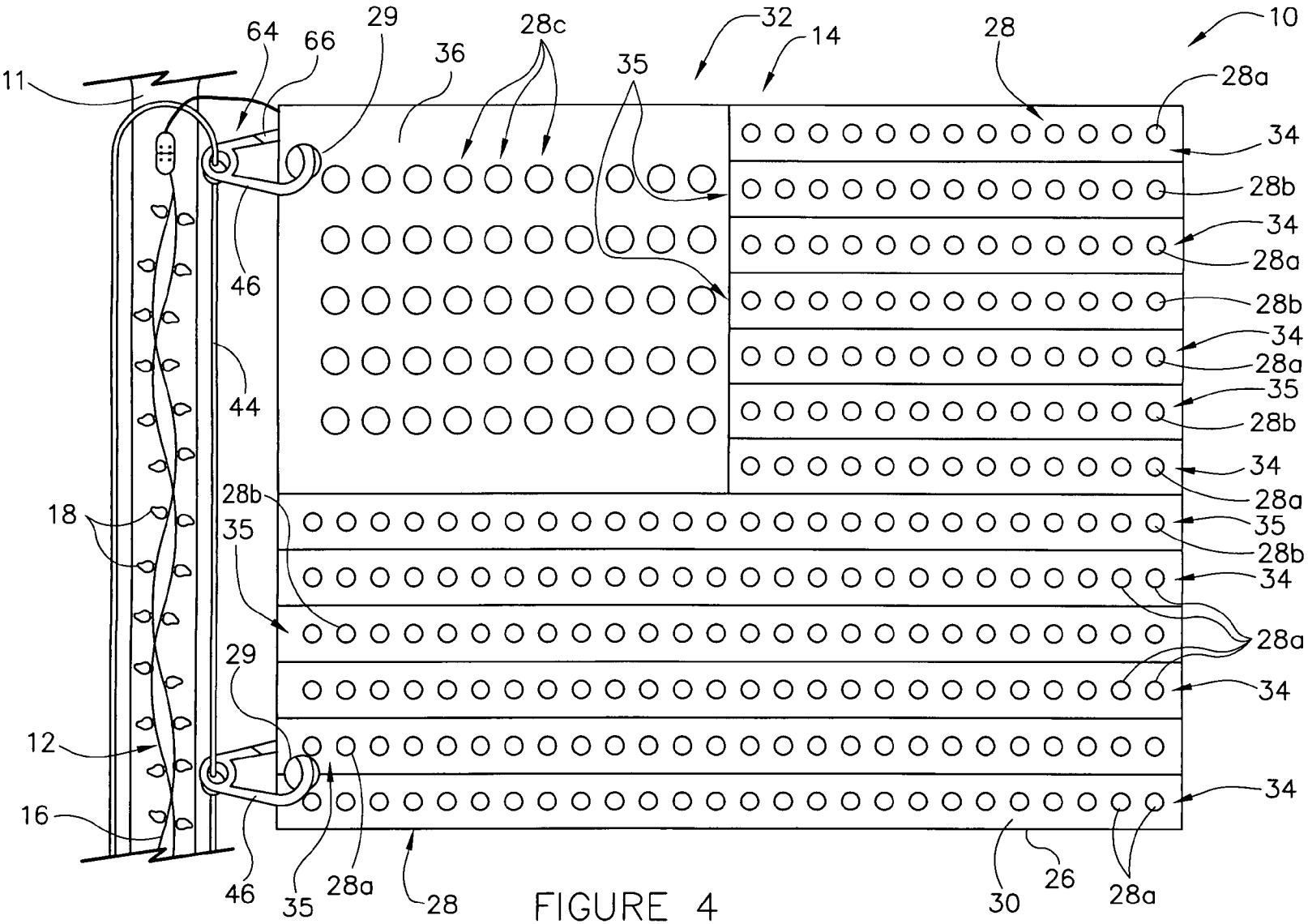
FIG. 4 is a detailed view of a decorative member or symbol of a decorative lighting system according to an exemplary embodiment.

According to an exemplary embodiment shown in FIGS. 1 and 4, system 10 comprises decorative symbol or member 14. Decorative member 14 comprises a backing sheet or base 26 (e.g., frame, surface, member, etc.) and a plurality of lights 28 arranged on base 26 to simulate the appearance of a desired symbol such as a flag, holiday symbol, sports logo, or other suitable design. According to various exemplary embodiments, the symbol may comprise an American flag, a state flag, a sports (team) logo, a NASCAR® race car number, a seasonal and/or holiday symbol (e.g., those symbols associated with U.S. or foreign holidays such as Halloween, Christmas, New Years, Independence Day, Thanksgiving, St. Patrick's Day, Valentine's Day, etc.). FIGS. 5 through 13 illustrate various decorative members having different symbols or designs simulated with lights and/or other materials. Although various exemplary embodiments of decorative members having various symbols or designs are presented for illustrative purposes, it is to be understood that these exemplary embodiments are not intended to be limiting and should not be construed as such as other variations and embodiments are within the scope of the appended claims. According to various exemplary embodiments, the lights may be any number of colors to simulate an appropriate symbol or design. According to various exemplary embodiments, the decorative members or symbols may comprise any number of suitable shapes (e.g., wavy flag shaped, rectangular, circular, triangular, three-dimensional, etc.).

Base 26 of decorative member 14 may be constructed of any suitable material so that lights 28 may be arranged thereon to simulate a desired appearance and/or resemble a suitable image or design on one or more sides of base 26. According to various exemplary embodiments, the base may be configured so that lights are arranged within the base and visible at various locations (e.g., though openings or apertures in the surface of the base). The lights may be coupled together and/or interconnected on and/or in the member via an electrical string such as a typical light strand and/or any other suitable electrical connection means. According to various exemplary embodiments, the base may be constructed of a pliant material, such as plastic or plastic mesh or any suitable pliant material, or otherwise shaped into a flag or other image and/or design. This allows the sheet to be rolled up when not in use (e.g., see FIG. 10). To stabilize the sheet during use, one or more stabilizing or rigid members (e.g., stiff rods extending through and/or across a length of the sheet) may be attached (e.g., coupled, mounted, interleaved into openings, etc.) to the sheet to prevent the sheet from rolling up or moving in an undesirable manner (e.g., waving, folding, bending, etc.). According to an exemplary embodiment, the rigid member may be formed or provided within a portion of the sheet. According to various exemplary embodiments, the base may be constructed from non-pliant materials such as rigid plastic, foam, nylon, acrylic, metal, steel, etc. According to an exemplary embodiment, the base may be configured to fold or bend for storage (e.g., member 14*p* shown FIG. 13). According to an exemplary embodiment, outer face or surface 30 of base 26 may include or be covered with paint, garland, fabric, or other material having suitable decorative appeal and coloring so that a particular design 32 is visible (e.g., a flag) when lights 28 do not provide light (e.g., such as during the daytime). One or both sides of the base may include lights, paint, garland, fabric or other suitable material. The base may also be substantially transparent, reflective, etc. FIGS. 5 through 13, which are described in greater detail below, show decorative symbols comprising lights and other materials (e.g., paint, fabric, etc.).

Figure 5:
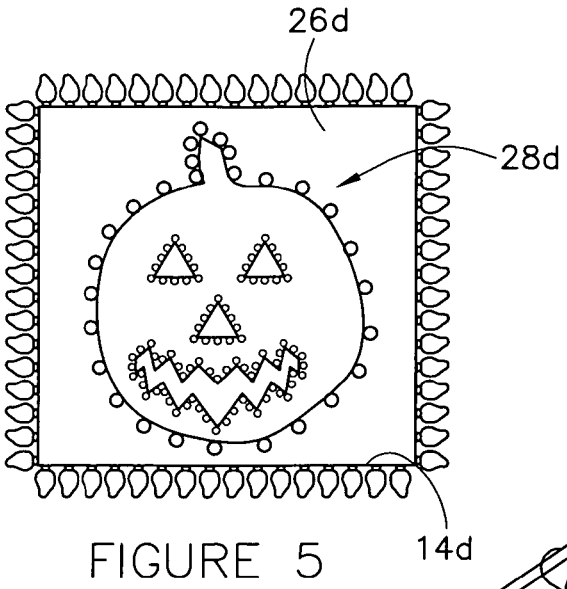
FIG. 5 is a front elevation view of a decorative member or symbol according to an exemplary embodiment.
Figure 6:
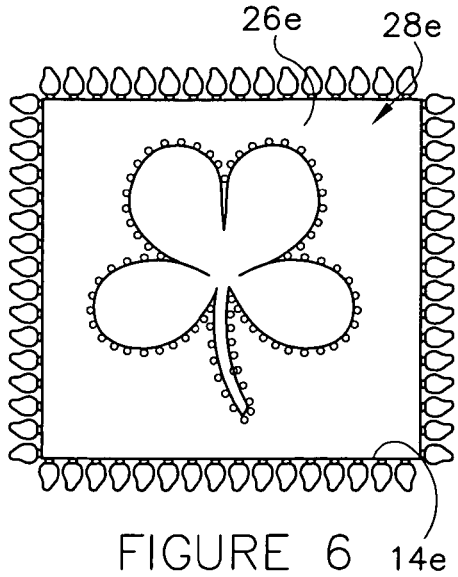
FIG. 6 is a front elevation view of a decorative member or symbol according to an exemplary embodiment.
Figure 7:
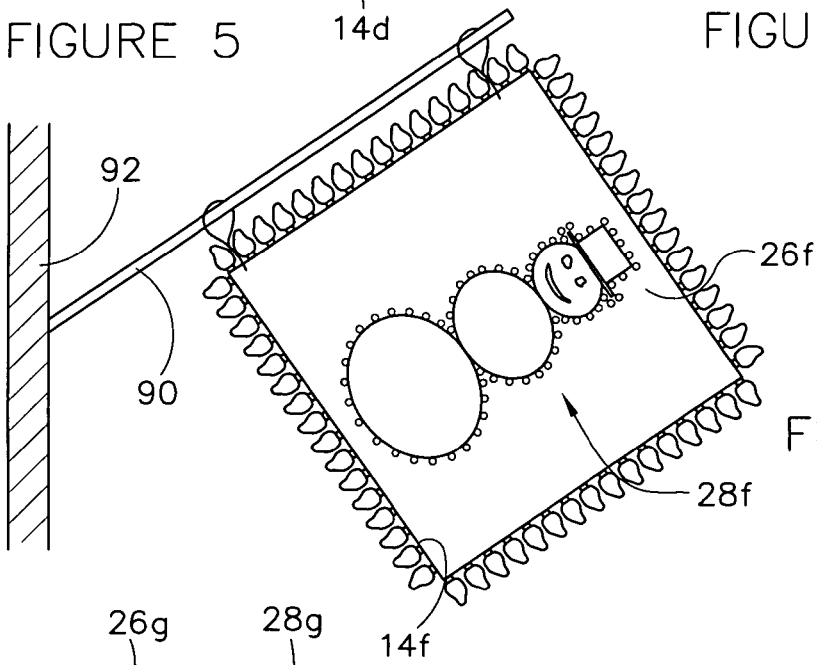
FIG. 7 is a front elevation view of a decorative member or symbol according to an exemplary embodiment.
Figure 8:
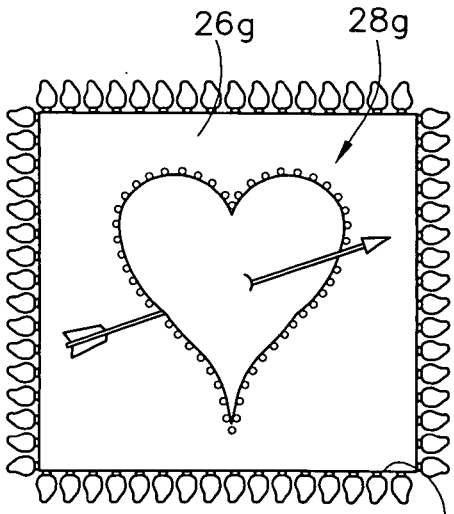
FIG. 8 is a front elevation view of a decorative member or symbol according to an exemplary embodiment.
Figure 9:
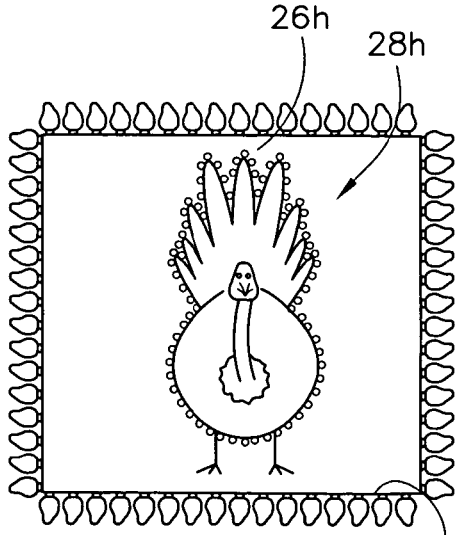
FIG. 9 is a front elevation view of a decorative member or symbol according to an exemplary embodiment.

According to an exemplary embodiment, ornaments or lights 28 are attached to base 26 which may be powered by an electrical outlet, a battery or other suitable power source. Lights 28 are arranged on base 26 to simulate the appearance of a chosen decorative symbol or design. As shown in FIGS. 1 and 4, lights 28 simulate the appearance of an American flag. According to an exemplary embodiment, rows 34 of red lights 28*a* and rows 35 of white (e.g., clear) lights 28*b* are provided on base 26 to correspond to the red and white stripes of the American flag. A plurality of blue lights 28*c* are provided in an overall rectangular (e.g., square) portion 36 having white or clear lights spaced apart within rectangular portion 36 thereby simulating stars interposed within the blue rectangular portion of the American flag. According to alternative embodiments, the lights and decorative materials may be arranged in any suitable configuration and may be any desired color to simulate the appearance of the American flag. According to alternative embodiments, the lights and decorative materials may be arranged in any suitable configuration and may be any desired color to simulate the appearance of other desired symbols or images. FIG. 5 provides an illustration of a pumpkin decorative member 14*d* having a base 26*d* and lights 28*d*. FIG. 6 provides an illustration of a St. Patrick's Day shamrock decorative member 14*e* having a base 26*e* and lights 28*e*. FIG. 7 provides an illustration of a winter snowman decorative member 14*f* having a base 26*f* and lights 28*f*. Member 14*f* is coupled to pole 90 (e.g., rod, beam, member, post, support, structure, rope, pulley system, etc.) which may be coupled to a structure, such as wall 92 of a building, home or other suitable structure. Pole 90 may be configured to extend from wall 92 at any suitable angle or in any suitable direction. Member 14*f* may or may not be used with a light strand, a pulley system, or any other feature of the system described herein. The member shown in FIG. 7 may comprise a sleeve portion that is configured to slide over the flagpole to couple the member to the flagpole. FIG. 8 provides an example of a Valentine's Day decorative member 14*g* having a base 26*g* and lights 28*g*. FIG. 9 provides an example of a Thanksgiving Day decorative member 14*h* having a base 26*h* and lights 28*h*. FIG. 10 provides an example of a New Year's decorative member 14*i* having a base 26*i* and lights 28*g*. FIG. 11 provides an example of a holiday wreath decorative member 14*j* having a base 26*j* and lights 28*j*. Decorative member 14*j* is shown coupled to bars 53 (e.g., rods, reinforcement bars, supports, members, etc.) that are provided along the edges of decorative member 14*j* for additional support. FIG. 12 provides an illustration of a decorative member 14*k* having a base 26*k*, lights 28*k* and a number or image that may be associated with a particular sports figure (e.g., NASCAR®, the NBA®, MLB®, the NFL®, etc.). Decorative member 14*k* is shown having a wavy configuration (e.g., a wind blown appearance).

According to various exemplary embodiments, one of a plurality of decorative members may be coupled to the elongate member. According to an exemplary embodiment shown in FIG. 14, elongate member 12 is couplable to interchangeable decorative members. Referring to FIG. 14, one end of elongate member 12 comprises a node 38 (e.g., plug) which is configured to couple to an electrical socket. A second end of elongate member 12 comprises a node 40 which may be a plug or a socket. Node 40 is configured to couple to a node 42 of a light strand of decorative member 14. The nodes of various decorative members may be coupled to the node and/or nodes of the elongate member. For example, the node of a Thanksgiving themed decorative member may be coupled to the node of the elongate member. The Thanksgiving themed decorative member may then be replaced with a Christmas themed decorative member having a node that couples to the node of the elongate member. The Christmas themed decorative member may then be replaced with an American Flag themed decorative member having a node that couples to the node of the elongate member. According to an exemplary embodiment, any number of decorative members may be coupled to the elongate member and replaced throughout a given time period (e.g., one member having the same design on each side may be attached, one member having a different design on each side may be attached, multiple members having the same or different designs on various sides may be attached, etc.). As shown in FIG. 14, decorative member 14 comprising lights 28 is coupled to structure (e.g., pole, rod, beam, member, pulley system, wire, rope, etc.), shown as a flagpole 45 and held in place with connectors 46*b* (shown as wing nut connectors 49 coupled to bars 47 that are positioned through apertures 51 in member 14). Elongate member 12 may be coupled to decorative member 14 at nodes 40, 42 which are intended to hold decorative member 14 in place with elongate member 12.

Figure 15:
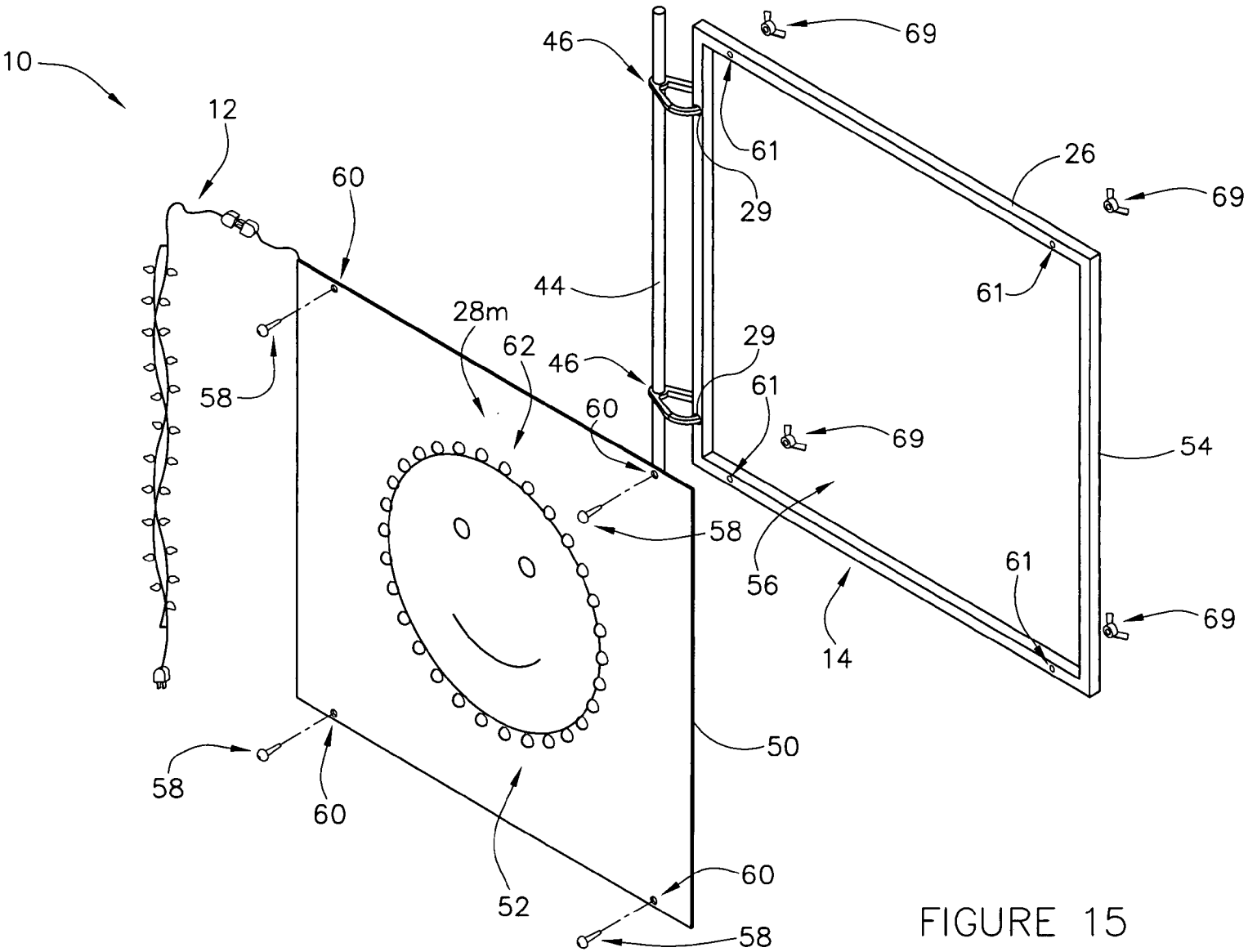
FIG. 15 is a schematic view of a decorative member or symbol of a decorative lighting system according to an exemplary embodiment.

According to an exemplary embodiment, interchangeable decorative panels may be coupled to and removed from the base of a decorative member. As shown in FIG. 15, an interchangeable decorative member or panel 50 having a decorative design or image 52 may be coupled to base 26 of decorative member 14. As shown in FIG. 15, base 26 comprises an open frame 54, shown as having an at least partially hollow or cut-out portion 56 (e.g., open area or portion). Panel 50 and frame 54 are configured to couple together. According to various exemplary embodiments, the frame and the panel may be configured for easy coupling and decoupling by using suitable connectors, VELCRO®, clips, magnets, etc. According to an exemplary embodiment shown in FIG. 15, connectors shown as screws 58 are inserted through apertures 60 provided in panel 50 and apertures 61 provided in frame 54 to couple frame 54 to panel 50 on a first side. Screws 58 may be tightened by wing nuts 69 or other suitable device. Panel 50 may comprise any suitable material such as plastic, metal, etc. and may be in formed as a plate, sheet, slab, rods, etc. According to an exemplary embodiment shown in FIG. 15, panel 50 comprises a plurality of lights 28*m* provided thereon in the shape of a happy or smiley face 62. Panel 50 is configured to couple to frame 54 so that panel 50 and frame 54 form a decorative member having a design or image simulated by the configuration of the lights and/or other material provided on panel 50. According to various exemplary embodiments, the panel (e.g., image, design, lights, etc.) or decorative member (e.g., frame) may comprise a node that couples to a node on the elongate member so that the lights are electrically powered when elongate member is connected to a power source (e.g., electrical socket). According to an exemplary embodiment, a Thanksgiving themed panel may be coupled to the base. The Thanksgiving themed panel may then be replaced with a Christmas panel. The Christmas themed panel may then be replaced with an American Flag panel. According to an exemplary embodiment, any number of panels may be coupled to the base and/or frame and replaced throughout a given time period (e.g., one panel having the same design on each side may be attached, one panel having a different design on each side may be attached, multiple panels having the same or different designs on various sides may be attached two a first and second side of the base, etc.). According to an exemplary embodiment, the use of a base and/or frame is optional. According to an exemplary embodiment, the panel may include connectors for directly coupling to the flagpole pulley with or without coupling to the frame and/or base.

System 10 comprises a connector 46 (e.g., snap hook, coupler, member, attachment device, etc.) that is configured to couple elongate member 12 and/or decorative member 14 to a flagpole or other suitable structure (e.g., post, beam, pole, building, etc.). According to an exemplary embodiment shown in FIG. 4, decorative member 14 comprises openings shown as apertures 29 configured so that connector 46 may couple to a flagpole and/or flagpole pulley system 44 and through apertures 29. As shown in FIG. 4 connector 46 comprises a clip 64 having a tension-loaded gate 66 (e.g., spring-loaded) for coupling and decoupling decorative member 14. Clip 64 may be made from any suitable material such as metal, aluminum, steel, plastic, etc. According to a preferred embodiment, connector 46 couples decorative member 14 to a flagpole so that decorative member 14 remains substantially flat and straight when raised on the flagpole. According to an exemplary embodiment, the connector may couple to any portion of the elongate member and/or decorative portion so that the decorative member and light strand may be viewable at a position on a flagpole with minimized bending, drooping, folding, etc. (e.g., the connector may be configured to attach to multiple portions or corners of the decorative member for additional support). According to various exemplary embodiments, a user may couple, attach, mount, etc. the decorative member to the flagpole as they would attach a standard flag to the flagpole and/or flagpole pulley system.

According to various exemplary embodiments, the assemblies and components of the systems may be constructed from various different materials. According to a preferred embodiment, the assemblies and components of the system are constructed from materials such as metal, steel, plastics, rubber, foam, fabrics, paints and/or any other suitable materials. In addition, various parts of the systems may be constructed and assembled as a single integrally formed piece or may be assembled and constructed from multiple parts.

It is important to note that the above-described embodiments are illustrative only. Although the system has been described in conjunction with specific embodiments thereof, those skilled in the art will appreciate that numerous modifications are possible without materially departing from the novel teachings and advantages of the subject matter described herein. For example, different types of decorative shaped lights systems may be used with the systems described herein. In addition, any suitable number of light strands, lights (e.g., light emitting diodes), decorative members, etc. may be used (e.g., one, three, five, etc.). Further, any suitable type of light may be used (e.g., different colors, blinking, different sized, etc.). Accordingly, these and all other such modifications are intended to be included within the scope of the present system as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangements of the preferred and other exemplary embodiments without departing from the spirit of the present system.

What is claimed is:

1. A decorative lighting apparatus comprising:

a decorative member comprising a plurality of lights configured to simulate an appearance of a decorative design; and an elongate member coupled to the plurality of lights;

wherein the plurality of lights are configured to provide light when electrically powered;

wherein the plurality of lights are configured to be in electric communication with an electric power source;

wherein the member is configured to couple to a flagpole pulley system so that the decorative member may be provided in at least a first position and a second position along a flagpole by moving the pulley system; and wherein the elongate member comprises a light strand having a plurality of lights configured to be suspended from the decorative member outside of the flagpole.

2. The apparatus of claim 1 wherein the decorative member is configured to be positioned in a substantially perpendicular manner relative to the flagpole.

3. The apparatus of claim 1 further comprising a connector configured to couple the decorative member to the flagpole pulley system so that the decorative member can be moved between a first height and a second height along the flagpole.

4. The apparatus of claim 1 wherein the appearance of a decorative design is simulated on a first and second side of the decorative member.

5. The apparatus of claim 1 wherein the decorative member comprises lights arranged to simulate a flag.

6. The apparatus of claim 1 wherein the decorative member comprises lights arranged to simulate a seasonal decoration.

7. The apparatus of claim 1 wherein the light strand comprises a substantially transparent flexible sleeve.

8. The apparatus of claim 1 wherein the decorative member comprises lights arranged to simulate a sports related design.

9. A decorative lighting apparatus comprising:

an elongate member comprising a plurality of illumination devices, the illumination devices providing light when electrically powered; and a decorative member configured to couple to the elongate member, wherein the decorative member comprises a plurality of illumination devices arranged to simulate a flag;

wherein the illumination devices are configured to be in electric communication with an electric power source to provide electric power to the illumination devices;

wherein the decorative member is configured to couple to a flagpole pulley system so that the decorative member can be moved between a first height and a second height along a flagpole; and wherein the illumination devices of the elongate member are configured to be suspended from the decorative member outside of the flagpole.

10. The apparatus of claim 9 wherein the flag is an American flag.

11. The apparatus of claim 9 wherein the elongate member comprises a light strand of illumination devices.

12. The apparatus of claim 9 wherein the illumination devices comprise lights.

13. The apparatus of claim 12 wherein the lights comprise a plurality of different colored lights.

14. The apparatus of claim 9 further comprising a connector for directly coupling the decorative member to the flagpole pulley system so that the decorative member is positioned in a substantially perpendicular manner relative to the flagpole.

15. A modular decorative lighting apparatus comprising:

a base configured to couple to a pulley system of a flagpole so that the base can be provided at one of a plurality of different heights along the flagpole by actuation of the pulley system;

a first interchangeable decorative member configured to removably couple to the base, wherein the first interchangeable decorative member comprises a plurality of illumination devices arranged to simulate an appearance of a decorative design; and an elongate member configured to couple to the plurality of illumination devices of the interchangeable decorative member;

wherein the base is configured for removable attachment of the first interchangeable decorative member to provide a first simulated appearance of a decorative design on a first side of the base;

wherein the illumination devices are configured to be in electric communication with an electric power source to provide electric power to the illumination devices when attached to the electric power source and wherein the elongate member comprises a plurality of illumination devices configured to be suspended from the decorative member outside of the flagpole.

16. The apparatus of claim 15 wherein the elongate member is configured to couple the illumination devices of the first interchangeable decorative member to the electric power source.

17. The apparatus of claim 15 wherein the first simulated appearance of a decorative design is provided on the first side of the base and a second side of the base when the first interchangeable decorative member is attached to the base.

18. The apparatus of claim 15 wherein the base is further configured for removable attachment of a second interchangeable member to provide a second simulated appearance of a decorative design on a second side of the base.

19. The apparatus of claim 15 wherein the base comprises a frame having a substantially open interior portion.

20. The apparatus of claim 15 wherein the decorative member is configured to be positioned in a substantially perpendicular manner relative to the flagpole.

* * * * *